US009304477B2

(12) United States Patent
Sone

(10) Patent No.: US 9,304,477 B2
(45) Date of Patent: Apr. 5, 2016

(54) IMAGE FORMING APPARATUS INCLUDING A CABLE HAVING A CURVED AREA

(71) Applicant: FUJI XEROX CO., LTD., Tokyo (JP)

(72) Inventor: Kazuhiro Sone, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/548,885

(22) Filed: Nov. 20, 2014

(65) Prior Publication Data

US 2015/0309468 A1 Oct. 29, 2015

(30) Foreign Application Priority Data

Apr. 23, 2014 (JP) ..... 2014-089171

(51) Int. Cl.

| | |
|---|---|
| ***B41J 2/435*** | (2006.01) |
| ***B41J 15/14*** | (2006.01) |
| ***B41J 27/00*** | (2006.01) |
| ***G03G 15/00*** | (2006.01) |
| ***G03G 21/16*** | (2006.01) |

(52) U.S. Cl.

CPC ..... *G03G 15/80* (2013.01); *G03G 21/1619* (2013.01); *G03G 21/1652* (2013.01); *G03G 21/1666* (2013.01)

(58) Field of Classification Search

USPC ..... 347/230, 238, 241, 242, 244, 245, 347/256–258, 263; 439/607.44, 607.49

See application file for complete search history.

(56) References Cited

U.S. PATENT DOCUMENTS

| | | | | |
|---|---|---|---|---|
| 6,037,964 A * | 3/2000 | Gomi | ..... | B41J 2/45 347/118 |
| 7,954,917 B2 * | 6/2011 | Inoue | ..... | 347/9 |
| 2011/0157295 A1 | 6/2011 | Sakamoto | | |

FOREIGN PATENT DOCUMENTS

| | | | | |
|---|---|---|---|---|
| JP | 2000-158749 A | | 6/2000 | |
| JP | 2000158749 A | * | 6/2000 | ..... B41J 29/00 |
| JP | 2009-139943 A | | 6/2009 | |
| JP | 2009139943 A | * | 6/2009 | ..... G03G 21/16 |
| JP | 2011-133773 A | | 7/2011 | |

* cited by examiner

*Primary Examiner* — Hai C Pham

(74) *Attorney, Agent, or Firm* — Sughrue Mion, PLLC

(57) ABSTRACT

Provided is an image forming apparatus including a casing body, an exposure portion in a rod shape that has a connector and exposes a target object, a first support portion that supports the exposure portion over a longitudinal direction of the exposure portion and is removed from the casing body by being moved in the longitudinal direction, and a cable that is connected to the exposure portion via the connector, transmits power to the exposure portion, has a curved area that is a part of the cable in a curved state, and is in contact with the first support portion in a part of the curved area, in a state where the first support portion is accommodated in the casing body.

12 Claims, 8 Drawing Sheets

IMAGE FORMING APPARATUS INCLUDING A CABLE HAVING A CURVED AREA

CROSS-REFERENCE TO RELATED APPLICATIONS

This application is based on and claims priority under 35 USC 119 from Japanese Patent Application No. 2014-089171 filed Apr. 23, 2014.

BACKGROUND (i) Technical Field

The present invention relates to an image forming apparatus.

(ii) Related Art

A piece of technology in which a signal is sent from a control section of an image forming apparatus to an exposure device through a cable is known.

SUMMARY

According to an aspect of the invention, there is provided an image forming apparatus including:

a casing body;

an exposure portion in a rod shape that has a connector and exposes a target object;

a first support portion that supports the exposure portion over a longitudinal direction of the exposure portion and is removed from the casing body by being moved in the longitudinal direction; and a cable that is connected to the exposure portion via the connector, transmits power to the exposure portion, has a curved area that is a part of the cable in a curved state, and is in contact with the first support portion in a part of the curved area, in a state where the first support portion is accommodated in the casing body.

BRIEF DESCRIPTION OF THE DRAWINGS

Exemplary embodiments of the present invention will be described in detail based on the following figures, wherein.

DETAILED DESCRIPTION

Figure 1:
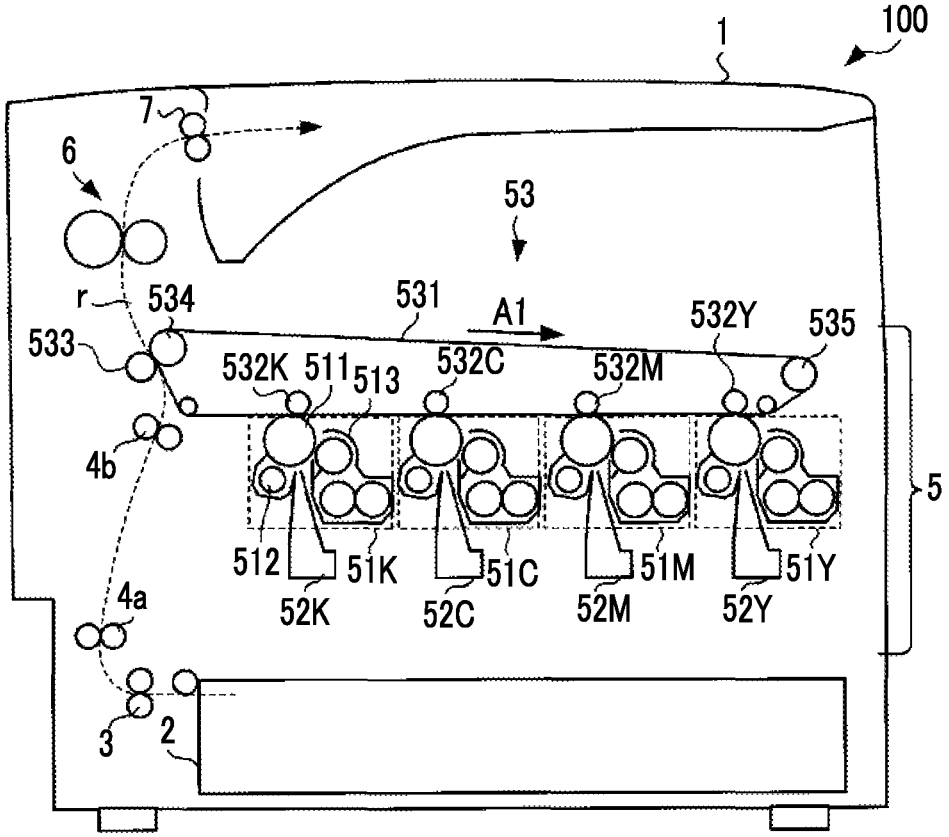
FIG. 1 is a view illustrating a schematic internal configuration of an image forming apparatus.

FIG. 1 is a view illustrating a schematic internal configuration of an image forming apparatus 100 according to an exemplary embodiment of the invention. In the image forming apparatus 100, a receiving portion 2, a feeding roll 3, transporting rolls 4 (4*a* and 4*b*), a transfer portion 5, a fixing device 6, and an output roll 7 are provided in a casing body 1. Paper sheets are received in the receiving portion 2. The feeding roll 3 comes into contact with a paper sheet received in the receiving portion 2 and feeds the paper sheet along a transporting route r. The transporting roll 4 transports the paper sheet fed by the feeding roll 3. The paper sheet is transported by the transporting roll 4 and passes through the transfer portion 5. The transfer portion 5 transfers a toner image onto the paper sheet transported by the transporting roll 4. The fixing device 6 causes the toner image to be fixed to the paper sheet in such a manner that the fixing device 6 then heats the paper sheet onto which the toner image is transferred by the transfer portion 5. The output roll 7 outputs, from the casing body 1, the paper sheet with toner fixed thereto.

The transfer portion 5 has plural photoconductor units 51 (51Y, 51M, 51C, and 51K), plural exposure units 52 (52Y, 52M, 52C, and 52K), and a belt unit 53. The photoconductor units 51Y, 51M, 51C, and 51K correspond to yellow (Y), magenta (M), cyan (C), and black (B) in a one to one relationship. The photoconductor units 51Y, 51M, 51C, and 51K are used for forming and holding the toner image. The photoconductor unit 51 has a photoconductor drum 511, a charging unit 512, and a developing device 513. The photoconductor drum 511 (an example of a target object) is a cylindrical-shaped member having an outer circumferential surface on which a photoconductive film is laminated. The photoconductor drum 511 is supported in a state where the photoconductor drum 511 rotates around the center of the cylinder. The charging unit 512 causes the photoconductive film of the photoconductor drum 511 to be charged to a predetermined potential. The developing device 513 forms a toner image in such a manner that the developing device 513 causes some of toners of yellow, magenta, cyan, and black to adhere to an electrostatic latent image formed on the photoconductor drum 511.

The exposure units 52Y, 52M, 52C, and 52K correspond to the photoconductor units 51Y, 51M, 51C, and 51K in a one to one relationship. The exposure unit 52 forms an electrostatic latent image in such a manner that the exposure unit 52 exposes the photoconductor drum 511 which is charged by the charging unit 512 and faces the exposure unit 52. Details of the exposure unit 52 will be described below. The belt unit 53 has an intermediate transfer belt 531, plural first transfer rolls 532 (532Y, 532M, 532C, and 532K), a second transfer roll 533, a backup roll 534, and a drive roll 535. The intermediate transfer belt 531 is an endless belt member onto which the toner image of each color, which is formed by the photoconductor unit 51, is transferred. The first transfer rolls 532Y, 532M, 532C, and 532K correspond to the photoconductor units 51Y, 51M, 51C, and 51K. The first transfer roll 532 transfers, to the intermediate transfer belt 531, the toner image formed by the photoconductor drum 511 facing the first transfer roll 532. The second transfer roll 533 and the backup roll 534 face each other and form a nip area in which both the paper sheet and the intermediate transfer belt 531 are pinched. Accordingly, the toner image transferred onto the intermediate transfer belt 531 is transferred onto the paper sheet. The drive roll 535 is a member which rotationally drives the intermediate transfer belt 531 in the direction of an arrow A1.

The image forming apparatus 100 has a control section, a communication portion, and a storage portion (not illustrated). The control section has a Central Processing Unit (CPU), a Read Only Memory (ROM), and a Random Access Memory (RAM) and controls the operation of each portion of the image forming apparatus 100 described above. The communication portion is connected to an external portion, such as a personal computer, and transmits/receives various data, such as image data. The storage portion has a unit, for example, a Hard Disk Drive (HDD), for storing data and programs used by the control section.

Figure 2:
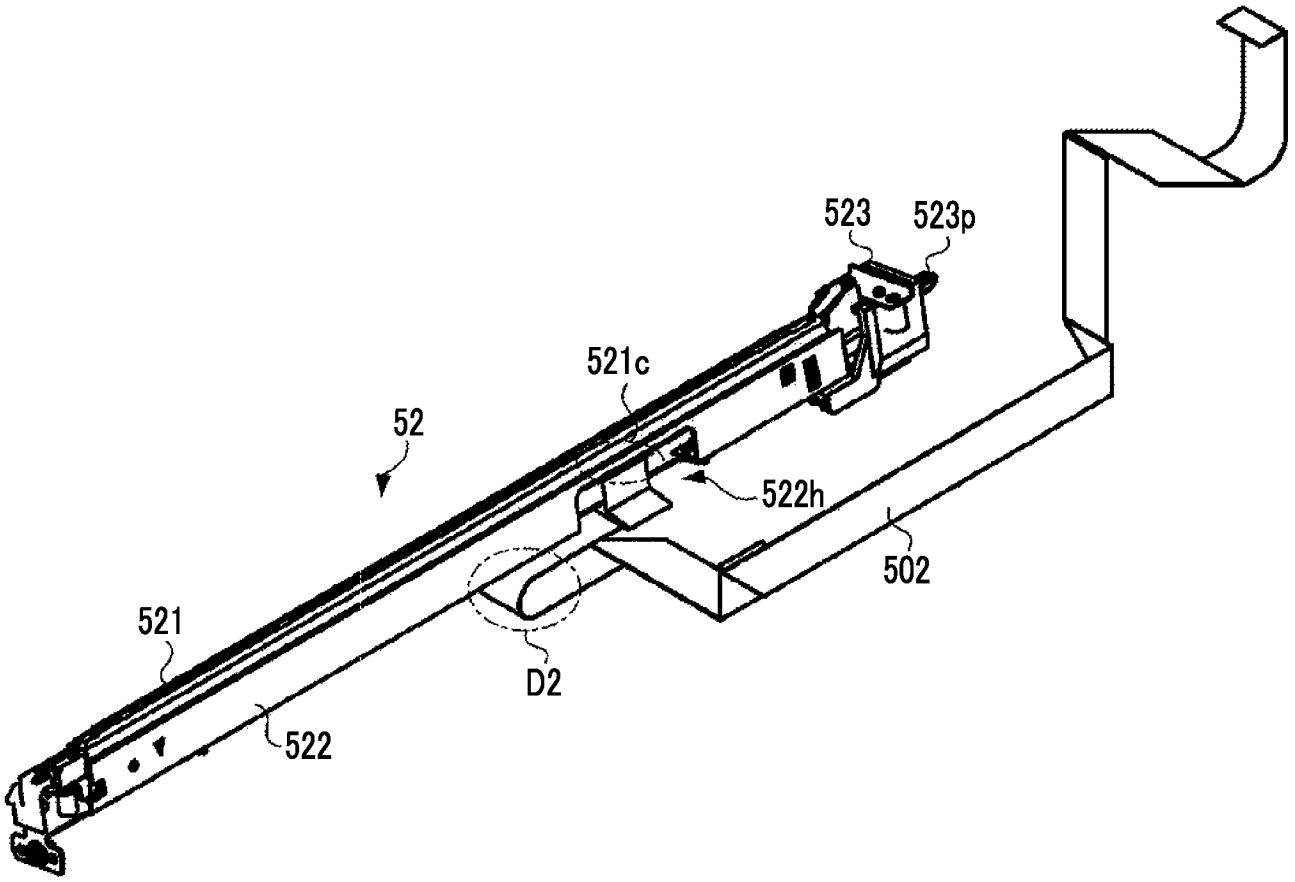
FIG. 2 is a view illustrating a configuration of an exposure unit.

FIG. 2 is a view illustrating a configuration of the exposure unit 52. The exposure unit 52 has an exposure portion 521, a support bar 522, and a mounting portion 523. The exposure portion 521 exposes the photoconductor drum 511. The exposure portion 521 has a substrate on which plural light emitting elements, such as a Light emitting Diode (LED), are one-dimensionally (linearly) arranged and a lens for converging light-rays from the light emitting elements. Power supply from the control section of the image forming apparatus 100 to the exposure portion 521 is performed through a cable 502. In FIG. 2, the cable 502 is a flexible flat cable (a cable constituted by plural flat conductors covered with a film-shaped insulator). The cable 502 is connected to the exposure portion 521 through a connector 521*c* of the exposure portion 521. The support bar 522 (an example of a first support portion) is a member supporting the exposure portion 521 over the longitudinal direction of the exposure portion 521. The support bar 522 is constituted by, for example, a metal plate. In the support bar 522, a hole 522*h* is provided in a part of a longitudinal area such that the connector 521*c* is exposed therethrough. The mounting portion 523 is a member for mounting the exposure unit 52 on the casing body 1. The mounting portion 523 has a projection 523*p*. The exposure unit 52 is accommodated (that is, the position of the exposure unit 52 is fixed relative to the casing body 1) in the casing body 1, in such a manner that the projection 523*p* is inserted into the hole formed on the casing body 1. Furthermore, the mounting portion 523 supports an end portion of the photoconductor drum 511, in a state where both the photoconductor unit 51 and the exposure unit 52 are accommodated in the casing body 1 (see FIG. 3). Since the mounting portion 523 supports the end portion of the photoconductor drum 511, the positional relationship between the exposure unit 52 and the photoconductor drum 511 is set.

Figure 3:
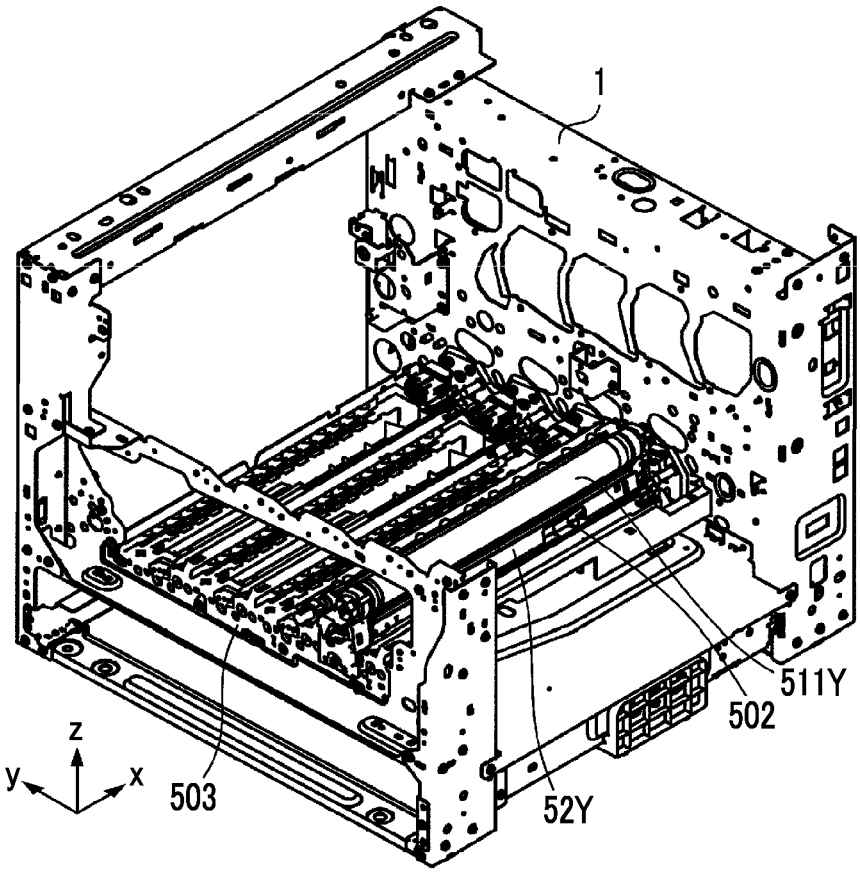
FIG. 3 is a view illustrating a state where the exposure unit is accommodated in a casing body.

FIG. 3 is a view illustrating a state in which the exposure unit 52 is accommodated in the casing body 1. In FIG. 3, the exposure unit 52Y and a photoconductor drum 511Y of the photoconductor unit 51Y are accommodated in the casing body 1. For the convenience of description, a three-dimensional orthogonal coordinate system will be defined below. In this coordinate system, an x-axis indicates the longitudinal direction of the exposure portion 521 (or the exposure unit 52), a y-axis indicates a lateral direction of the exposure portion 521 in a state where the exposure portion 521 is viewed from the photoconductor drum 511 side, and a z-axis indicates a height direction of the image forming apparatus 100. When the exposure unit 52 is accommodated in the casing body 1, the exposure unit 52 is supported by a support plate 503 (an example of a second support portion). The support plate 503 is a member mounted on the casing body 1 and supports the support bar 522 of the exposure unit 52. In FIG. 3, the exposure unit 52 is accommodated in the casing body 1 in such a manner that the exposure unit 52 is slid in a positive x-axis direction and inserted into the casing body 1. The exposure unit 52 is removed from the casing body 1 in such a manner that the exposure unit 52 is slid in a negative x-axis direction. Furthermore, in the casing body 1, a side from which the exposure unit 52 is inserted is a front side of the image forming apparatus 100 and a side in which the inserted exposure unit 52 abuts on the casing body 1 is a rear side of the image forming apparatus 100. Accordingly, in the casing body 1, a hole with which the projection 523*p* (see FIG. 2) of the exposure unit 52 is engaged is formed on the rear side of the image forming apparatus 100. When the exposure unit 52 is removed from the casing body 1, the projection 523*p* is pulled out from the hole on the casing body 1.

The cable 502 is wired from the rear side of the image forming apparatus 100. In the casing body 1, the exposure portion 521 and the cable 502 are connected in a position closer to a rear surface of the image forming apparatus 100 than a front surface. In such a configuration, when the exposure unit 52 is removed from the casing body 1, to perform, for example, replacing of the exposure portion 521, in some cases, an operator removes the cable 502 from the exposure portion 521 in such a manner that the operator operates the connector 521*c* (see FIG. 2) in the inner portion of the casing body 1. In this case, an operator removes the cable 502 from the exposure portion 521 in a state (that is, a state where the position of the connector 521*c* is moved to the front side of the image forming apparatus 100) where the exposure unit 52 is slid to the front side of the image forming apparatus 100, to the position in which the projection 523*p* comes off from the hole on the casing body 1. When the cable 502 is removed from the exposure portion 521, an operator removes the exposure unit 52 from the casing body 1, in such a manner that the exposure unit 52 is slid further to the front side of the image forming apparatus 100.

Figure 4:
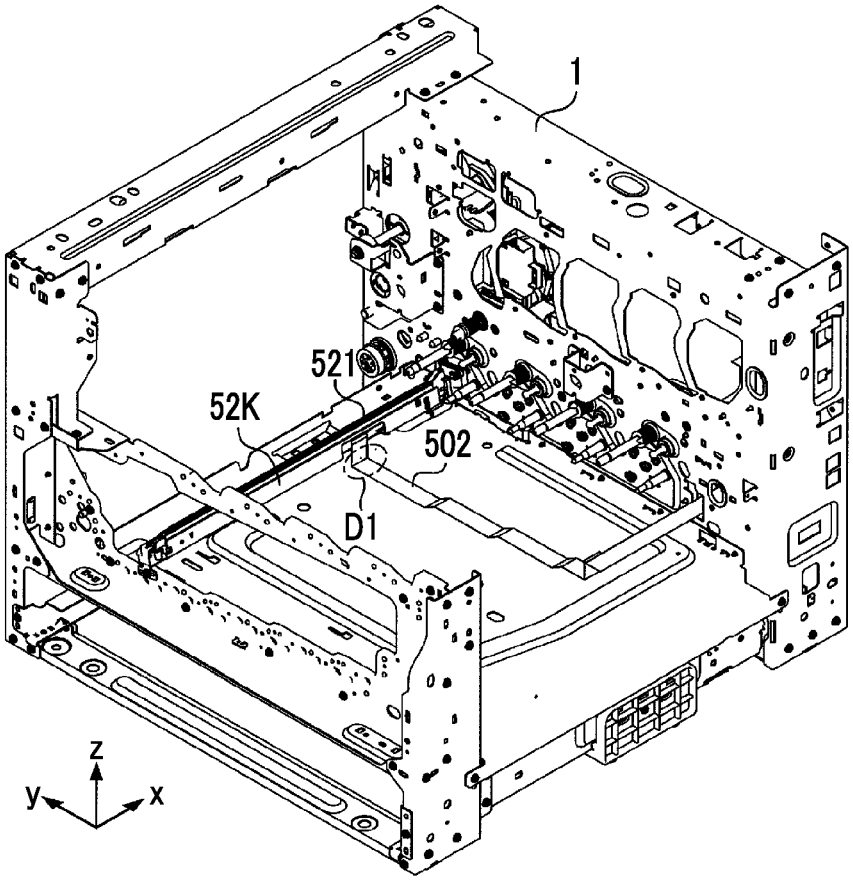
FIG. 4 is a comparative example illustrating a state where the exposure unit is accommodated in the casing body.

FIG. 4 illustrates a comparative example in a state where the exposure unit 52 is accommodated in the casing body 1. In FIG. 4, the exposure unit 52K is accommodated in the casing body 1, in a state where the photoconductor unit 51 is removed from the casing body 1. In FIG. 4, the cable 502 is bent in an area D1. The area D1 is in contact with the support plate 503 (not illustrated) and the cable 502 is supported, in the area D1, against the support plate 503. In FIG. 4, the cable 502 bent in the area D1 is connected to the exposure portion 521 without having a curved area. The reaction force of the force applied from the cable 502 to the support plate 503 is applied to the exposure portion 521 through the cable 502. Accordingly, when the exposure unit 52 is accommodated in the casing body 1, there is a possibility that the exposure portion 521 may be deformed by the force applied from the cable 502 to the exposure portion 521. Furthermore, in FIG. 4, when, in order to remove the exposure unit 52 from the casing body 1, the exposure unit 52 is slid to the front surface of the image forming apparatus 100, to the position in which the projection 523*p* (see FIG. 2) comes off from the hole on the casing body 1, there is a possibility that the exposure portion 521 may be deformed due to a pulling force applied from the cable 502 to the exposure portion 521. In the image forming apparatus 100 of the exemplary embodiment, the cable 502 is connected to the exposure portion 521, in a state where a part of the cable 502 is curved. Accordingly, when the exposure unit 52 is accommodated in the casing body 1 or the exposure unit 52 is removed from the casing body 1, the exposure portion 521 is prevented from being deformed.

FIG. 2 will be referred to again. In the exemplary embodiment of the invention, the cable 502 is curved in a U-shape, in an area D2 (hereinafter, referred to as a "curved area D2"). In FIG. 2, the cable 502 is curved in the longitudinal direction of the exposure portion 521. The cable 502 is connected to the exposure portion 521, in a state where a part of the cable 502 in the curved area D2 is in contact with the support bar 522.

Figure 5A:
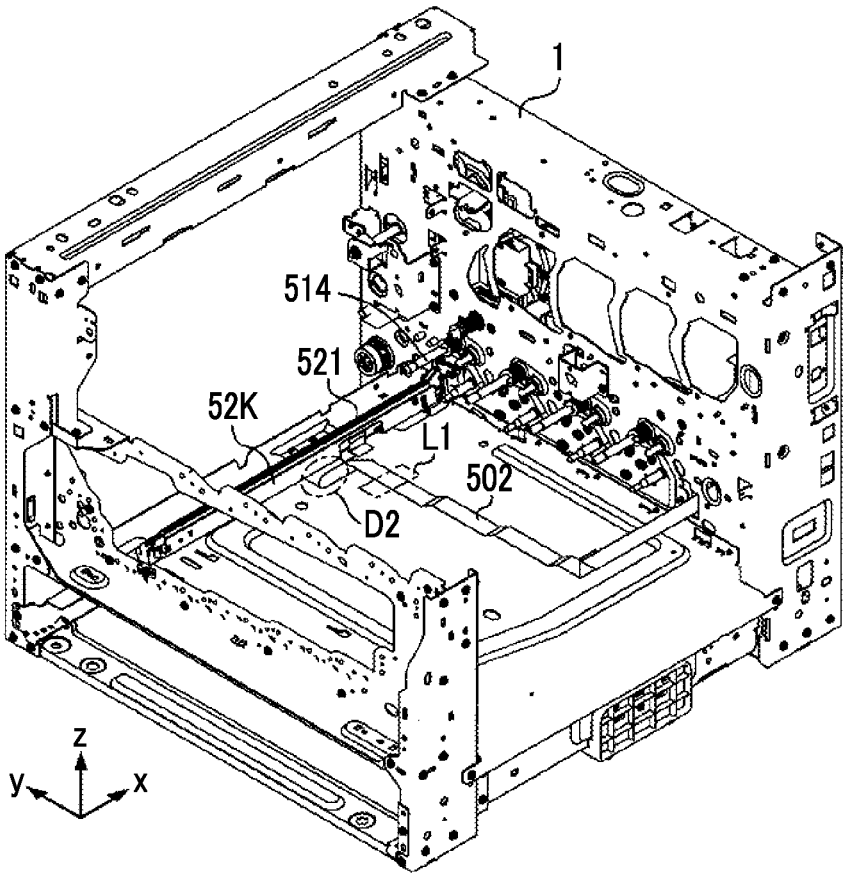
FIG. 5A is a view illustrating a state where the exposure unit is accommodated in the casing body.
Figure 5B:
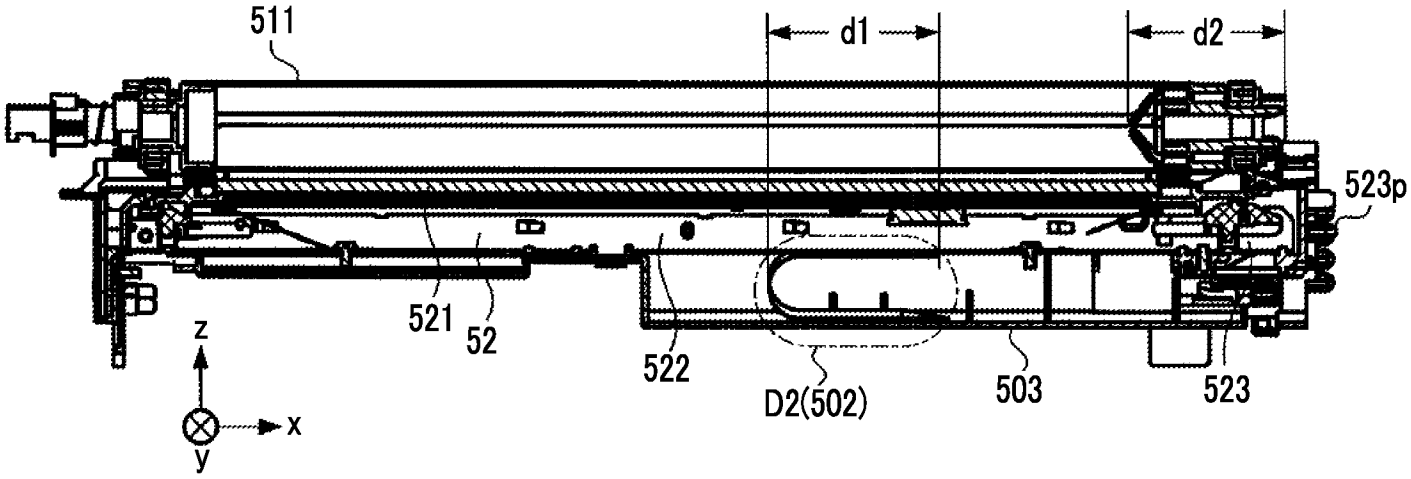
FIG. 5B is a view illustrating both a photoconductor drum and the exposure unit in a state where the photoconductor drum and the exposure unit are accommodated in the casing body.

FIGS. 5A and 5B are views illustrating a state where, in the exemplary embodiment of the invention, the exposure unit 52 is accommodated in the casing body 1. FIG. 5A illustrates a state where the exposure unit 52K is accommodated in the casing body 1. FIG. 5B is a view illustrating both the photoconductor drum 511 and the exposure unit 52 in a state where the photoconductor drum 511 and the exposure unit 52 are accommodated in the casing body 1, when seen from the lateral direction of the exposure portion 521. In a state where the exposure unit 52 is accommodated in the casing body 1, the curved area D2 is curved in the negative x-axis direction (that is, in a direction in which the exposure unit 52 is removed from the casing body 1), as illustrated in FIGS. 5A and 5B. Apart of the upper portion of the curved area D2 in the height direction is in contact with the support bar 522, as illustrated in FIG. 5B, and a part of the lower portion of the curved area D2 in the height direction is in contact with the support plate 503. The support plate 503 supports the cable 502, in the curved area D2. When the curved area D2 illustrated in FIGS. 5A and 5B is provided in the cable 502, the reaction force of the force applied from the cable 502 to the support plate 503 is applied to the support bar 522 through the cable 502, and thus the force applied from the cable 502 to the exposure portion 521 is reduced. Accordingly, when the exposure unit 52 is accommodated in the casing body 1, the exposure portion 521 is prevented from being deformed.

The cable 502 is fastened to the support plate 503, in a position (that is, in a position in the cable 502, for example, the position indicated by a dashed line L1 in FIG. 5A, located closer to the control section of the image forming apparatus 100 than the curved area D2) located further away from the exposure portion 521 than the curved area D2. In a state where the exposure unit 52 is accommodated in the casing body 1, a curved amount d1 of the cable 502 in the curved area D2 is equal to or greater than a length d2 of a shaft 514 (see FIG. 5A) which transmits power from a driving portion to the photoconductor drum 511, as illustrated in FIG. 5B. In this case, in the total length of the shaft 514 in the longitudinal direction, the "length of the shaft 514" does not include the length of the portion engaged with the casing body 1. In FIG. 5B, the length of the portion in which the photoconductor drum 511 is engaged with the shaft 514 is illustrated as the length d2 of the shaft 514.

Figure 6A:
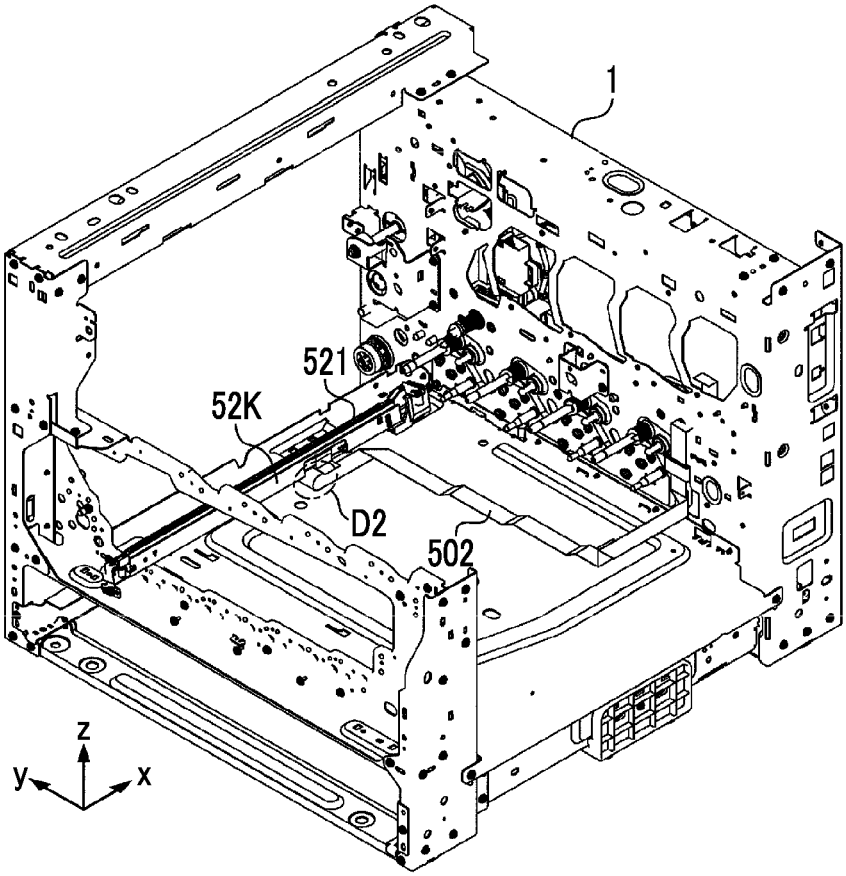
FIG. 6A is a view illustrating an operation at the time of removing the exposure unit from the casing body.
Figure 6B:
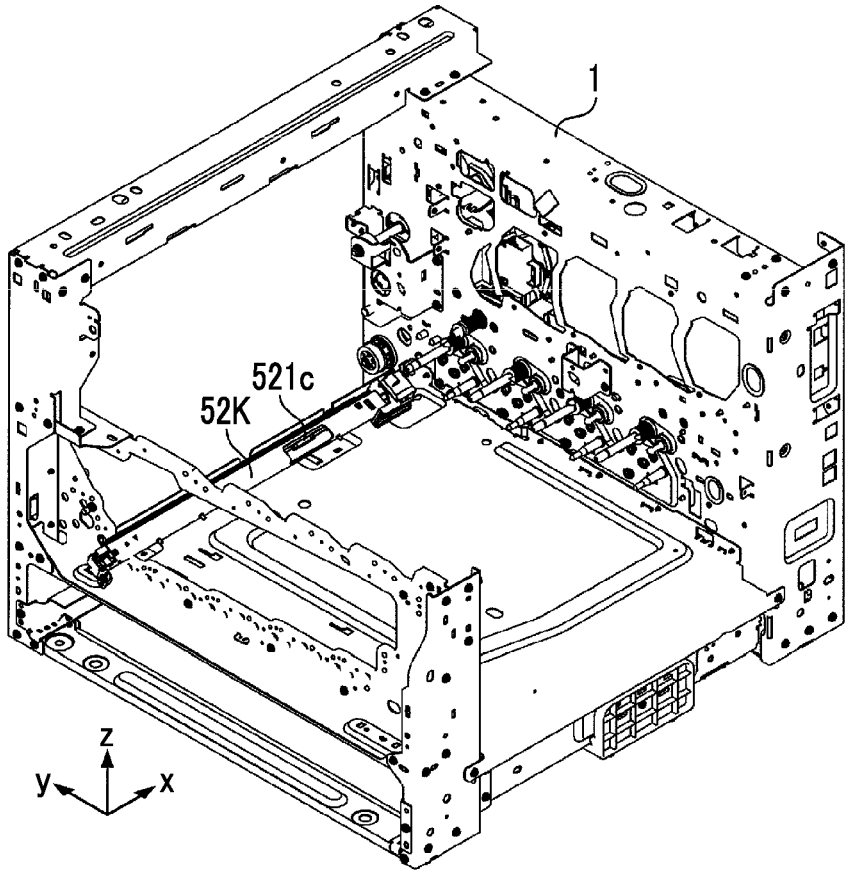
FIG. 6B is a view illustrating an operation at the time of removing the exposure unit from the casing body.

In the invention, FIGS. 6A and 6B are views illustrating an operation at the time of removing the exposure unit 52 from the casing body 1. FIG. 6A illustrates a state where the exposure unit 52K in the state illustrated in FIG. 5A is slid in the negative x-axis direction. Specifically, FIG. 6A illustrates a state where an operator slides the exposure unit 52K to the position where the projection 523*p* (see FIG. 2) comes off from the hole on the casing body 1. When the exposure unit 52K is slid in the negative x-axis direction, the curved amount of the cable 502 in the curved area D2 is reduced, compared to a state (see FIG. 5A) where the exposure unit 52K is accommodated in the casing body 1, as illustrated in FIG. 6A. Since the curved amount of the cable 502 in the curved area D2 changes at the time of removing the exposure unit 52 from the casing body 1, the pulling force applied from the cable 502 to the exposure portion 521 is reduced. As a result, when the exposure unit 52 is removed from the casing body 1, the exposure portion 521 is prevented from being deformed.

In a state illustrated in FIG. 6A, an operator rotates the exposure unit 52K in the positive y-axis direction. Rotating of the exposure unit 52K is performed to ease the operation by which an operator removes the cable 502 from the exposure portion 521 by operating the connector 521*c*. FIG. 6B illustrates a state where the exposure unit 52K in the state illustrated in FIG. 6A is rotated in the positive y-axis direction and the cable 502 is removed. In the state illustrated in FIG. 6B, an operator slides the exposure unit 52K in the negative x-axis direction and removes the exposure unit 52K from the casing body 1.

The invention is not limited to the exemplary embodiment described above and may be modified in various ways. Hereinafter, modification examples will be described. Plural the modification examples described below may be used in combination.

(1) The curved area D2 is not limited to a case where the curved area D2 is curved in the negative x-axis direction. The curved area D2 may be curved in, for example, the positive x-axis direction.

(2) The configuration of the exposure unit 52 is not limited to the configuration described above. For example, the support bar 522 may be formed in such a manner that an insulating member, such as plastic, is applied to the main body constituted by a conductor, such as a metal plate and a part of the curved area D2 may be in contact with the support bar 522, in the insulating member. In another example, the support bar 522 may be formed by an insulating member, such as plastic.

(3) The exposure unit 52 may not be removed from the casing body 1, in a state where the components of the exposure unit 52 are integrally combined. For example, the exposure portion 521 may be removed from the support bar 522, in the casing body 1 and the exposure portion 521 may be removed from the casing body 1 alone.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a casing body;

an exposure portion in a rod shape that has a connector and is configured to expose a target object;

a first support portion configured to support the exposure portion over a longitudinal direction of the exposure portion, and to be removed from the casing body by being moved in the longitudinal direction; and a cable configured to be connected to the exposure portion via the connector, wherein the cable is configured to transmit power to the exposure portion, and wherein the cable has a curved area that is a part of the cable in a curved state in a height direction of the cable, wherein the image forming apparatus is configured such that the cable is in contact with the first support portion in apart of the curved area, in a state where the first support portion is accommodated in the casing body, wherein the image forming apparatus further comprises a second support portion that is mounted on the casing body and is configured to support the first support portion, wherein the image forming apparatus is configured such that the curved area is in contact with the second support portion in an area different from the part of the curved area in contact with the first support portion, in a state where the first support portion is accommodated in the casing body, and wherein the image forming apparatus is configured such that the cable is fastened to the second support portion in a position located further away from the exposure portion than the curved area.

2. The image forming apparatus according to claim 1, wherein the curved area is curved in the longitudinal direction.

3. The image forming apparatus according to claim 2, wherein the curved area is curved in a direction in which the first support portion is configured to be removed from the casing body.

4. The image forming apparatus according to claim 3, wherein the first support portion comprises a main body comprising a conductor and an insulating member, and wherein a part of the curved area is in contact with the insulating member.

5. The image forming apparatus according to claim 2, wherein the first support portion comprises a main body comprising a conductor and an insulating member, and wherein a part of the curved area is in contact with the insulating member.

6. The image forming apparatus according to claim 1, wherein the first support portion comprises a main body comprising a conductor and an insulating member, and wherein a part of the curved area is in contact with the insulating member.

7. An image forming apparatus comprising:

a casing body;

an exposure portion in a rod shape that has a connector and is configured to expose a target object;

a first support portion configured to support the exposure portion over a longitudinal direction of the exposure portion, and to be removed from the casing body by being moved in the longitudinal direction; and a cable configured to be connected to the exposure portion via the connector, wherein the cable is configured to transmit power to the exposure portion, and wherein the cable has a curved area that is a part of the cable in a curved state in a height direction of the cable, wherein the image forming apparatus is configured such that the cable is in contact with the first support portion in a part of the curved area, in a state where the first support portion is accommodated in the casing body, wherein the first support portion comprises a main body comprising a conductor and an insulating member, and wherein a part of the curved area is in contact with the insulating member.

8. The image forming apparatus according to claim 7, further comprising:

a second support portion that is mounted on the casing body and is configured to support the first support portion, wherein the image forming apparatus is configured such that the curved area is in contact with the second support portion in an area different from the part of the curved area in contact with the first support portion, in a state where the first support portion is accommodated in the casing body.

9. An image forming apparatus comprising:

a casing body;

an exposure portion in a rod shape that has a connector and is configured to expose a target object;

a first support portion configured to support the exposure portion over a longitudinal direction of the exposure portion, and to be removed from the casing body by being moved in the longitudinal direction; and a cable configured to be connected to the exposure portion via the connector, wherein the cable is configured to transmit power to the exposure portion, and wherein the cable has a curved area that is a part of the cable in a curved state in a height direction of the cable, wherein the image forming apparatus is configured such that the cable is in contact with the first support portion in a part of the curved area, in a state first support portion is accommodated in the casing body, and wherein the image forming apparatus is configured such that a curved amount of the curved area is equal to or greater than a length of a shaft configured to transmit power from a driving portion to the target object, in a state where the first support portion is accommodated in the casing body.

10. An image forming apparatus comprising:

a casing body;

an exposure portion in a rod shape that has a connector and is configured to expose a target object;

a first support portion configured to support the exposure portion over a longitudinal direction of the exposure portion, and to be removed from the casing body by being moved in the longitudinal direction; and a cable configured to be connected to the exposure portion via the connector, wherein the cable is configured to transmit power to the exposure portion, and wherein the cable has a curved area that is a part of the cable in a curved state, wherein the image forming apparatus is configured such that the cable is in contact with the first support portion in a part of the curved area, in a state where the first support portion is accommodated in the casing body, wherein the image forming apparatus further comprises a second support portion that is mounted on the casing body and is configured to support the first support portion, wherein the image forming apparatus is configured such that the curved area is in contact with the second support portion in an area different from the part of the curved area in contact with the first support portion, in a state where the first support portion is accommodated in the casing body, and wherein the image forming apparatus is configured such that the cable is fastened to the second support portion in a position located further away from the exposure portion than the curved area.

11. An image forming apparatus comprising:

a casing body;

an exposure portion in a rod shape that has a connector and is configured to expose a target object;

a first support portion configured to support the exposure portion over a longitudinal direction of the exposure portion, and to be removed from the casing body by being moved in the longitudinal direction; and a cable configured to be connected to the exposure portion via the connector, wherein the cable is configured to transmit power to the exposure portion, and wherein the cable has a curved area that is a part of the cable in a curved state, wherein the image forming apparatus is configured such that the cable is in contact with the first support portion in a part of the curved area, in a state where the first support portion is accommodated in the casing body, wherein the first support portion comprises a main body comprising a conductor and an insulating member, and wherein a part of the curved area is in contact with the insulating member.

12. An image forming apparatus comprising:

a casing body;

an exposure portion in a rod shape that has a connector and is configured to expose a target object;

a first support portion configured to support the exposure portion over a longitudinal direction of the exposure portion, and to be removed from the casing body by being moved in the longitudinal direction; and a cable configured to be connected to the exposure portion via the connector, wherein the cable is configured to transmit power to the exposure portion, and wherein the cable has a curved area that is a part of the cable in a curved state, wherein the image forming apparatus is configured such that the cable is in contact with the first support portion in a part of the curved area, in a state where the first support portion is accommodated in the casing body, and wherein the image forming apparatus is configured such that a curved amount of the curved area is equal to or greater than a length of a shaft configured to transmit power from a driving portion to the target object, in a state where the first support portion is accommodated in the casing body.

* * * * *